United States Patent [19]

Shaw

[11] Patent Number: 4,938,724

[45] Date of Patent: Jul. 3, 1990

[54] LINE CUTTING DEVICE

[76] Inventor: Robin D. Shaw, 252 Hursley, Winchester, Hampshire SO21 2JJ, England

[21] Appl. No.: 216,633

[22] PCT Filed: Dec. 18, 1986

[86] PCT No.: PCT/GB86/00778

§ 371 Date: Jun. 23, 1988

§ 102(e) Date: Jun. 23, 1988

[87] PCT Pub. No.: WO87/03856

PCT Pub. Date: Jul. 2, 1987

[30] Foreign Application Priority Data

Dec. 24, 1985 [GB] United Kingdom ..... 8531791

[51] Int. Cl.[5] ..... B63H 5/16

[52] U.S. Cl. ..... 440/73; 416/146 R

[58] Field of Search ..... 440/71, 72, 73; 416/146 R, 146 B; 114/221 A; 83/673, 675

[56] References Cited

U.S. PATENT DOCUMENTS

| | | | |
|---|---|---|---|
| 732,568 | 6/1903 | Lee | 440/73 |
| 756,031 | 3/1904 | Lee | 440/73 |
| 1,214,238 | 1/1917 | Taubert | 114/221 A |
| 1,272,168 | 7/1918 | Youngren | 114/221 A |
| 1,390,397 | 9/1921 | Svenson | 416/146 R |
| 1,649,657 | 11/1927 | Blake | 440/73 |
| 1,813,540 | 7/1931 | Laska | 416/146 B |
| 2,666,485 | 1/1954 | Antosh | 83/675 |
| 3,371,720 | 3/1968 | Blanchard | 416/146 B |
| 4,211,515 | 7/1980 | Henrich | 416/146 R |
| 4,447,215 | 5/1984 | Govan | 440/73 |
| 4,507,091 | 3/1985 | Govan | 440/73 |

FOREIGN PATENT DOCUMENTS

| | | | |
|---|---|---|---|
| 256544 | 4/1970 | U.S.S.R. | 416/146 B |
| 15013 | of 1892 | United Kingdom | 416/146 B |
| 255537 | 4/1925 | United Kingdom . | |
| 1057713 | 6/1964 | United Kingdom . | |
| 2139169 | 4/1984 | United Kingdom . | |

*Primary Examiner*—Joseph F. Peters, Jr.
*Assistant Examiner*—Jesûs D. Sotelo
*Attorney, Agent, or Firm*—Mattern, Ware, Stoltz & Fressola

[57] ABSTRACT

In a line cutting device of the type adapted to be mounted on the propeller shaft of a water-borne vessel for the purpose of cutting lines, ropes, nets, plastic bags or other debris which may foul the blades of a propeller on the shaft, a stationary cutting blade assembly is mounted so as to be restrained against rotation by cooperation with a shaft bearing. The stationary cutting blade assembly having a radially extending stationary cutting blade with an axially directed face and at least one circumferentially directed face defining a cutting edge therebetween. A rotatable cutting blade assembly is mounted for rotation with the propeller shaft and has at least one radially extending rotatable cutting blade thereon with an axially directed face and at least one circumferentially directed face defining a cutting edge therebetween. Upon rotation, the rotatable cutting blade assembly is arranged with respect to the stationary cutting blade assembly to provide a desired cutting action between the cutting edge of each rotatable cutting blade and the stationary cutting blade. Serrations on the cutting blades enhance the cutting action of the blades.

15 Claims, 5 Drawing Sheets

FIG. 7.
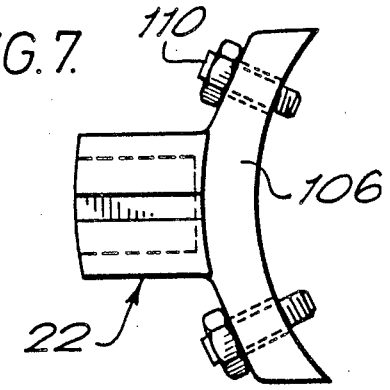
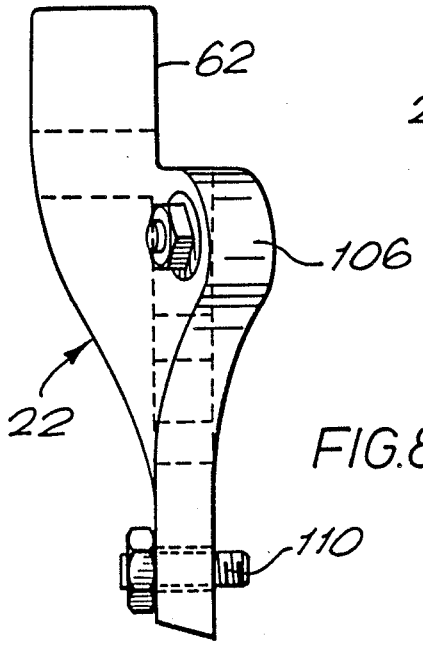
FIG. 8.
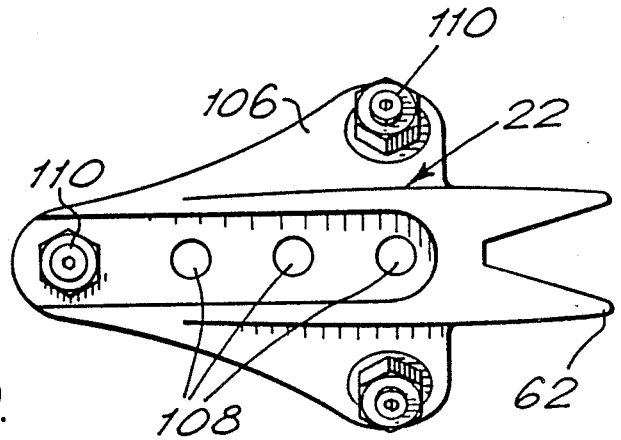
FIG. 9.

LINE CUTTING DEVICE

FIELD OF THE INVENTION

This invention relates to line cutting devices of the type adapted to be mounted on the propeller shaft of a water-borne vessel for the purpose of cutting lines, ropes, nets, plastic bags or other debris which may foul the blades of a propeller on the shaft.

BACKGROUND OF THE INVENTION

Such a device is disclosed in British Patent Specification No. GB-A-2139169, and comprises a stationary blade projecting radially from a ring and restrained against rotation by cooperation with a propeller shaft bearing, and a pair of diametrally opposed rotatable blades projecting radially from another ring to be secured to the propeller shaft. The blades have straight cutting edges on both sides lying radially to the rings, so that the width of the blades increases radially outwardly to form fan-shaped or dovetailed blades. At the distal or radially outward free end of each blade integral ear portions project forwardly and rearwardly, in the direction of rotation. Thus the ear portion on the leading edge of a rotating blade engages the ear portion on the opposed edge of the stationary blade before the cutting edges co-operate to shear a line therebetween. The intention of the ear portions is to prevent jamming of the blades as they wear. As the cutting edges approach during rotation, a line caught in the space therebetween tends to slide radially outwardly along the cutting edges until stopped by the ear portions, so that cutting usually takes place with the line at the distal or radially outward ends of the cutting edges. The moment of the cutting forces when cutting takes place there is greater than if it takes place closer to the rings. In addition, cutting takes place through the full width of a line in one action and this may prove difficult or impossible with large lines.

THE INVENTION

The object of the invention is to overcome this problem by providing a progressive cutting of fouled lines which enables even large diameter lines to be successfully cut without jamming.

According to the invention, there is provided a line cutting device for mounting around a propeller shaft between a shaft bearing and a propeller comprising a rotatable cutting blade assembly mountable for rotation with the propeller shaft and including at least one rotatable cutting blade extending generally radially of the propeller shaft and having a cutting edge provided between an axially directed face and a circumferentially directed face; and a stationary cutting blade assembly adapted to be restrained against rotation by co-operation with the shaft bearing and including a stationary cutting blade extending generally radially of the propeller shaft, having a cutting edge provided between an axially directed face and a circumferentially directed face and arranged for cutting action of its cutting edge with the cutting edge of the rotatable cutting blade on rotation of the propeller shaft with the axially directed faces passing opposite each other during such rotation; wherein the cutting edge of the or each rotatable cutting blade and/or the cutting edge of the stationary cutting blade is/are provided with serrations, and the cutting edges are shaped for cutting action of inner ones of the serrations prior to such action of outer serrations on continued rotation of the propeller shaft.

The serrations tend to grip a fouled line and if it is larger than can be fully cut by the first engaged serration(s), the outer serrations are engaged sequentially, progressively cutting the line.

Preferably, the axially directed faces of the stationary and rotatable cutting blades are flat and the respective circumferentially directed face(s) is/are provided with a tooth formation, whereby the said cutting edge(s) is/are provided with the said serrations.

The tooth formation is conveniently of saw-tooth shape and the circumferentially directed face(s) having this tooth formation is/are raked back from its cutting edge, whereby the cutting edge(s) is/are provided with points.

Although cutting edges are preferably provided on both edges of blade members, this may not be necessary if the device is to be mounted on a propeller shaft having a single direction of rotation.

Preferably, the saw-tooth shape is such as to be more sharply inclined along the portions outwardly inclined from the general radial direction of the blade member than along the portions inclined inwardly towards the general direction.

In the preferred embodiment, the rotatable cutting blade assembly includes a split hub adapted for clamping to the propeller shaft, the hub providing an annular groove at one end and a circular cylindrical seat at a mid portion for the stationary cutting blade assembly and having the rotatable cutting blade(s) radiating from its other end with its/their axially directed face(s) directed towards the circular cylindrical seat, and a split collar of greater radial dimension than the depth of the groove and clampable to the hub at the groove, whereby the stationary cutting blade assembly is axially limited in the seat.

Conveniently, the stationary cutting blade assembly includes a split ring accommodatable at the circular cylindrical seat, and means for axially splitting the ring for mounting to the seat prior to fitting of the collar to the hub.

THE DRAWINGS

To help understanding of the invention a specific embodiment thereof will now be described by way of example and with reference to the accompanying drawings, in which:

FIGS. 7,8 and 9 are end, side and plan views of a striker block intended to be secured to the propeller shaft bearing and to restrain the stationary cutting blade assembly against rotation.

THE EMBODIMENT

Figure 1:
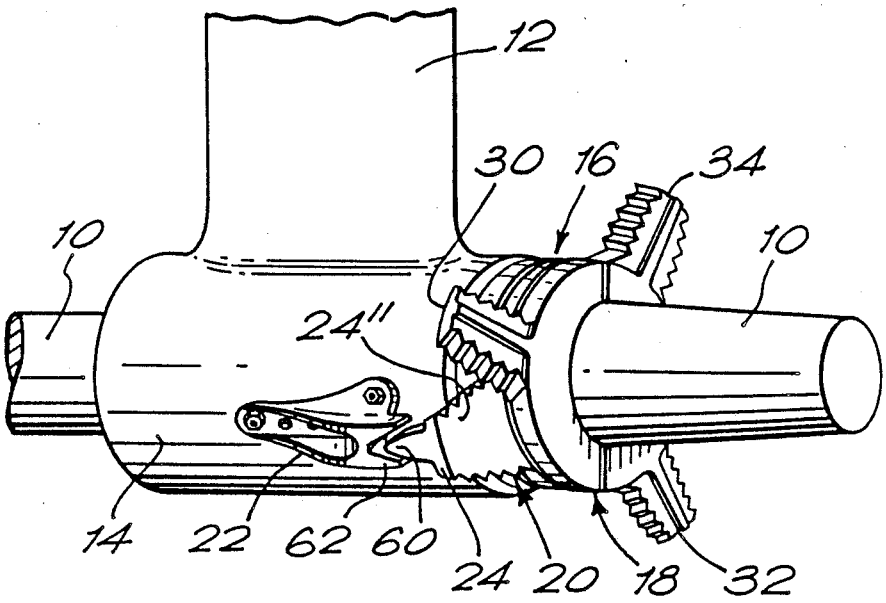
FIG. 1 is a perspective view, partly broken away, of a line cutting device according to the invention fitted to a propeller shaft itself mounted in shaft bearing.

Referring to the drawings, a water-borne vessel (not shown) has a propeller shaft 10 (see FIG. 1) supported in a propeller shaft bearing in the form of a strut 12 with a boss 14 containing a journal for the shaft 10. On the aft side of the boss 14, the shaft 10 carries a line cutting device 16 including a rotatable cutting blade assembly 18 and a stationary cutting blade assembly 20. The latter is restrained against rotation by a striker block 22 secured to the boss 14. A propeller (not shown) will in use be fitted behind the line cutting device.

Figure 2:
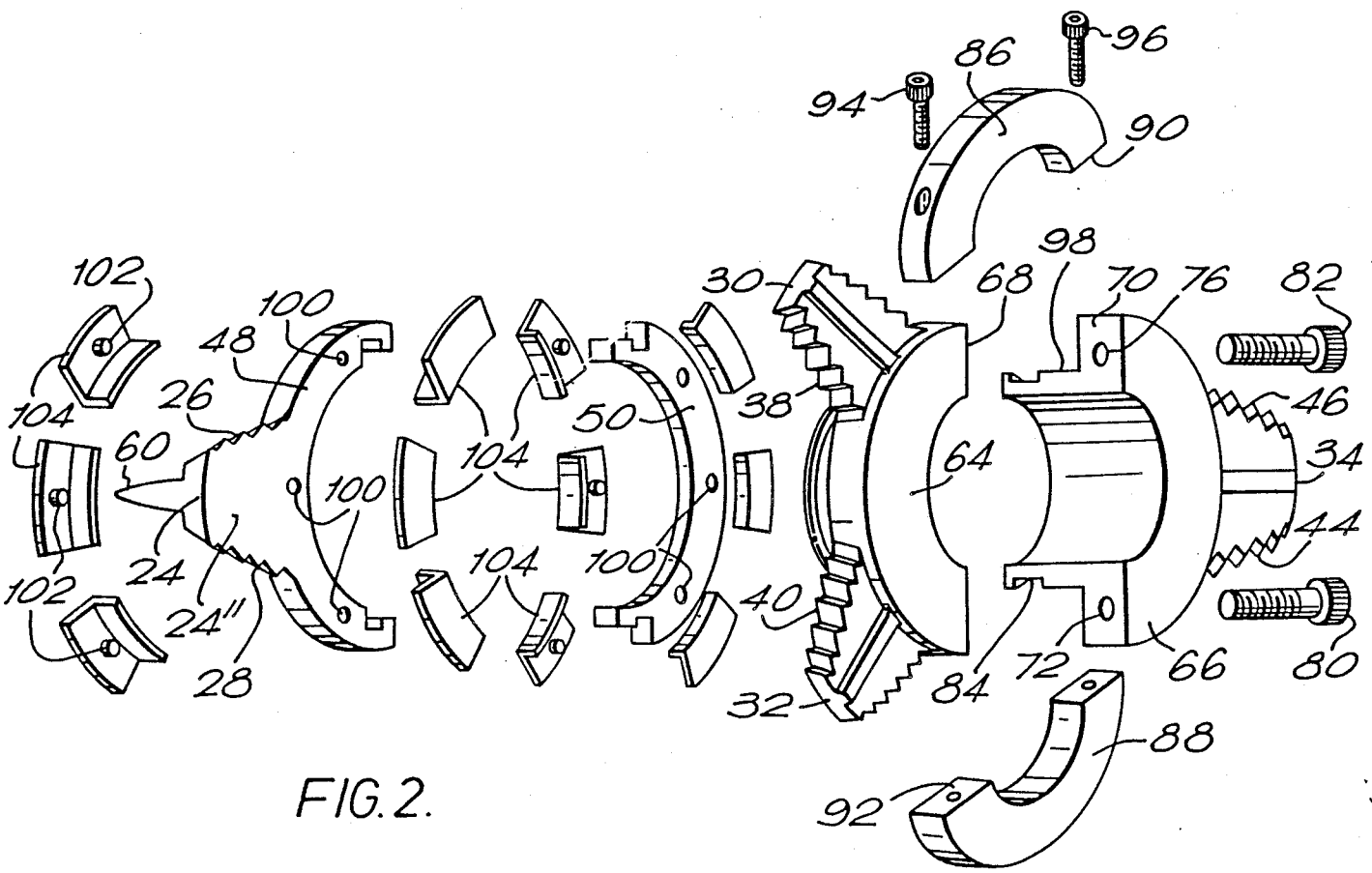
FIG. 2 is an exploded view of the line cutting device of FIG. 1.

In the preferred embodiment illustrated and described, the stationary cutting blade assembly 20 includes a radially outwardly projecting stationary blade 24 whose opposed cutting edges 26 and 28 (see FIG. 2) are serrated. The rotatable cutting blade assembly 18 is secured to the propeller shaft 10 to rotate therewith and includes three equally spaced radially outwardly projecting rotatable blades 30,32,34. The blades 30,32,34 have opposed cutting edges 36 and 38,40 and 42,44 and 46, respectively, which are serrated. The blades narrow towards their outer ends, so that, in operation, the radially inward portions of the cutting edges co-operate in a cutting action, before the radially outward portions thereof.

The stationary cutting blade assembly 20 comprises two half-rings 48 and 50 having complementarily formed ends 52,54; 56,58 (see FIG. 5) which interlock to form a complete ring. Half ring member 48 has neck portions 52',56', defining inwardly facing notches, which carry lugs 52",56". The other half ring member 50 has neck portions 54',58', defining outwardly facing notches which carry the lugs 54",58". The lugs are of reduced radial dimension to fit the notches on axial assembly of the half ring members to each other. Half ring member 48 carries the blade 24 as an integral part. The blade 24 has on its surface closer to the strut 12 and boss 14, a forwards projection 60 of wedge tooth shape. This projection engages in a bifurcated end 62 of the striker block 22 mounted on the boss 14 (see FIG. 1).

Figure 5:
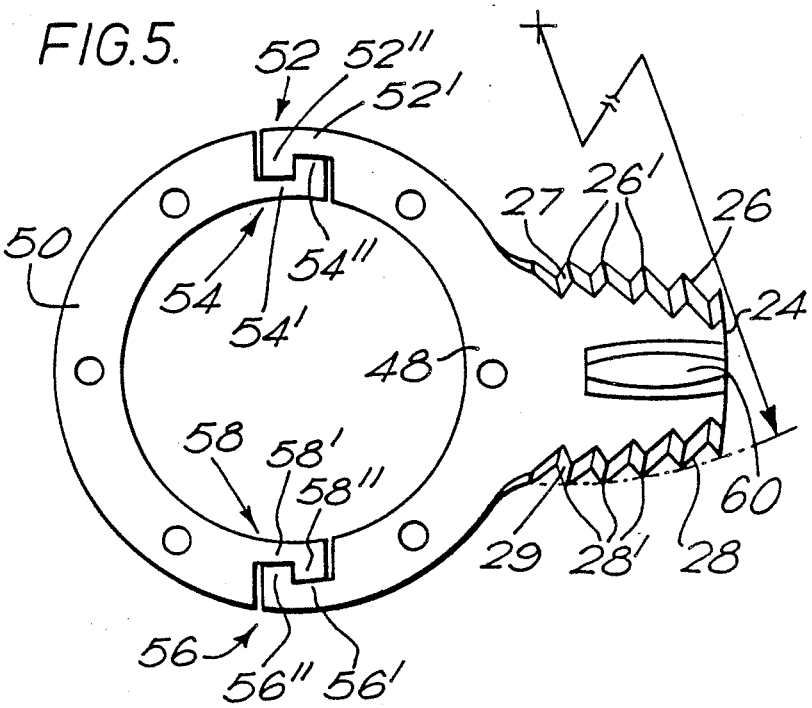
FIGS. 5 and 6 are end and side views of a stationary cutting blade assembly of the device of FIG. 2.
Figure 6:
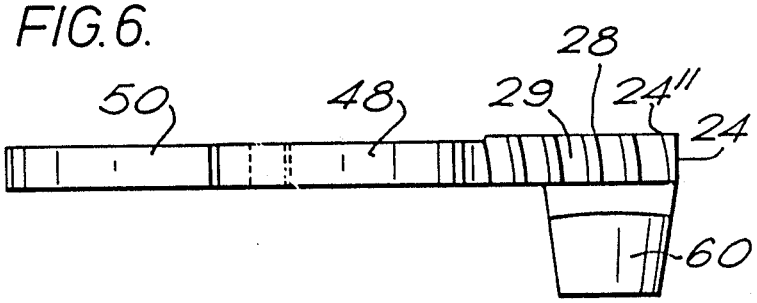

The serrated shape of the cutting edges of the blades is achieved by generating saw-tooth formations on the circumferentially directed faces 27,29,37,39,41,43,45,47 of the blades, each tooth terminating at its cutting edge in a serration (see FIG. 5).

The circumferentially directed faces curve towards each other from their inner to their outer ends. The result is that as each rotatable blade 30,32,34 passes the stationary blade 24, the radially inner serrations pass in a cutting action well in advance of the radially outer teeth. The circumferentially directed faces formed with the saw teeth are raked back from the cutting edges to provide points 26',28',36',38',40',42',44',46' at the cutting edges to dig into any line or other matter to be cut. The saw teeth on the different blades are provided at equivalent radial positions, whereby the points on the stationary blade align with the points on each rotating blade approaching the stationary blade. The stationary blade 24 and the rotating blades 30,32,34 have flat axially directed faces 24",30",32",34", which pass opposite each other during rotation. The faces 30",32",34" remain spaced from the face 24" by the thrust bearing thickness of bearing elements 104, described below.

Figure 3:
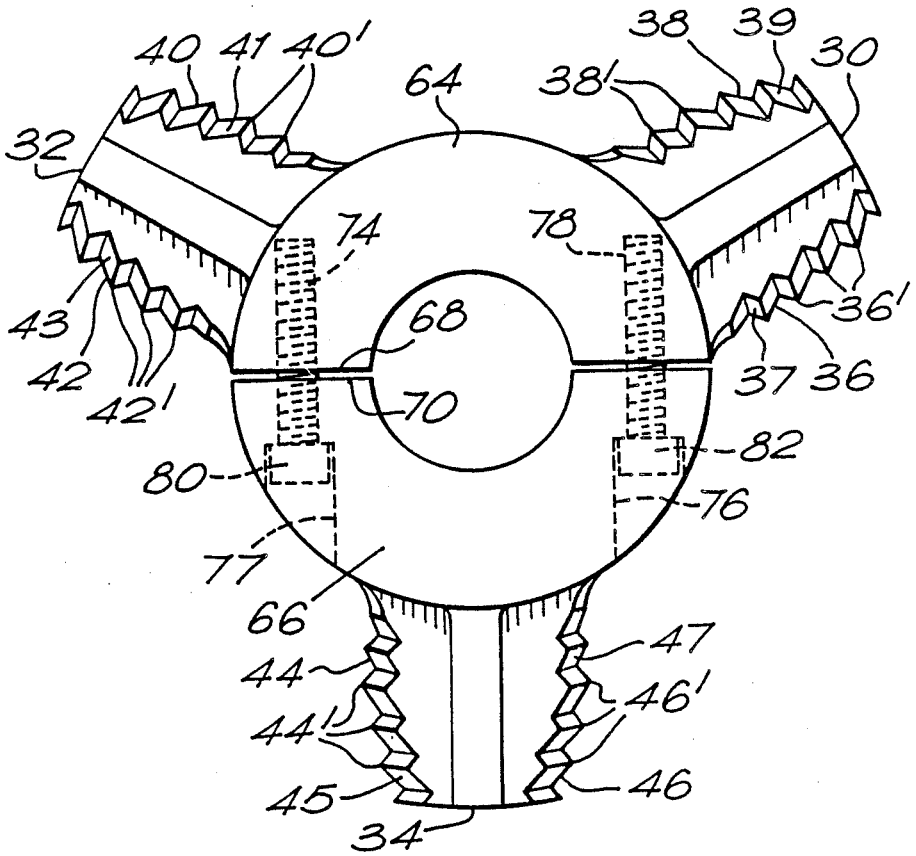
FIGS. 3 and 4 are end and side views of a rotatable cutting blade assembly of the device of FIG. 2.
Figure 4:
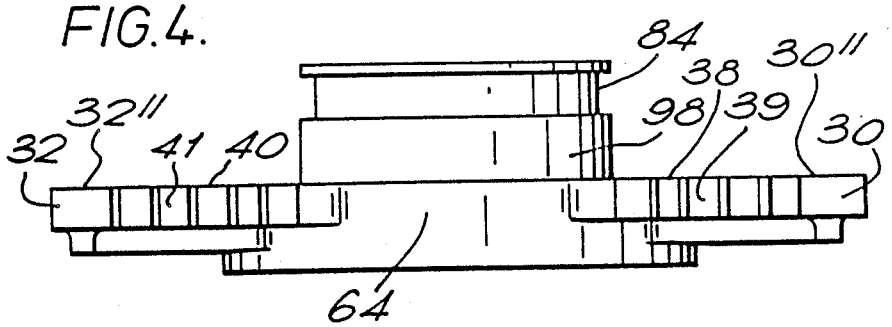

The rotatable cutting blade assembly 18 includes a hub comprised of two half hub members 64,66 having opposed faces 68,70 (see FIG. 3). Aligned pairs of holes 72,74; 76,78 in the half hub members 64,66 open through the faces 68,70 and bolts 80,82 passed through the holes 72,76 engage in the holes 74,78 which are threaded to enable the half hub members to be joined together to form a complete hub tightly engageable upon the propeller shaft 10. The half hub member 64 integrally carries two blades 30,32. The half hub member 66 integrally carries one blade 34. The hub 64,66 extends forwardly to provide an annular groove 84 for an additional pair of half collar members 86,88 which have opposed faces 90,92 intended to be set at right angles to the faces 68,70, whereby the half collar members 86,88 each bridge one of the circumferential joints in the hub at the faces 68,70 and bring the half hub members 64,68—and their blade members 30,32,34—into axial alignment. The additional half collar members 86,88 are joined together by two bolts 94,96 in a manner similar to the half hub members 64,66. The central portions of the half hub members 64,66, together with the half ring members 86,88, thus provide an axially limited circular cylindrical seat 98 for the stationary cutting blade assembly 20.

Each of the half ring members 48,50 has three recesses 100 on each face of the member. Each recess 100 receives a boss 102 integral with one arm of a combined journal and thrust bearing segment 104 of L-shaped cross-section made of an anti-friction plastics material such as TUFFCOTE-MOLY. The half ring members 48,50, complete with their bearing segments 104, are assembled and carried on the seat 98 provided on the half hub members 64,66.

The sequence of mounting on the propeller shaft 10 is for the half hub members 64,66 to be offered up to the shaft and the bolts 80,82 loosely engaged. One of the half ring members 48,50—with its bearing segments—is positioned at the seat 98 and the other offered up so that the complementary end formations 52,54; 56,58 engage axially. The half collar members 86,88 are then engaged in their annular groove 84 with the bolts 94,96 being loosely engaged. Tightening of bolts 80,82 and then of bolts 94,96 secures the rotatable cutting blade assembly tightly on the shaft 10, with the stationary cutting blade assembly journalled thereon.

The striker block 22 has a base member 106 (see FIG. 7) which has a curvature substantially that of the boss 14. The block 22 has three fixing screw holes 108 (see FIG. 9) along its centre line via which it is secured to the boss 14 with tension bolts not shown. Three adjustable compression studs 110 are provided in lugs to either side and one end of the striker block to provide adjustable three legged support against the hub for the case where the block 22 requires to be spaced slightly from the boss 14. The vee-shaped bifurcated end 62 of the striker block 22 projects from the back of the base member 106 and is aligned to and engages with the forward wedge projection 60 on the blade 24. To provide for contact substantially midway along the radial extent of the projection 60, its faces are barrelled.

In use, the rotatable cutting blade assembly 18 rotates with the propeller shaft and if a line becomes entangled therewith, one of the rotating blades 30,32,34 catches it against the sawteeth serrations thereof and carries it into contact with the stationary blade 24. Continued relative rotation causes the opposed cutting edges of the blades to sever the line. If the line is large, the radially inner sawtooth serrations of the rotating blade grip the fouled line so that when it is engaged by the radially inner sawtooth serrations of the stationary blade, it is divided into portions between radially successive serrations and the portions progressively cut by the sequentially engaging serrations.

Figure 10:
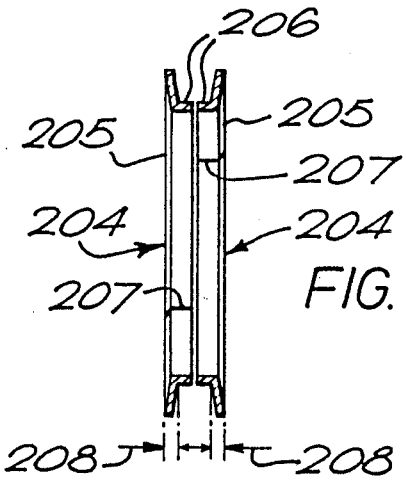
FIG. 10 is a cross-sectional view of a modified bearing element for the line cutting device.

FIG. 10 shows alternative bearing elements 204. Each has a thrust flange 205 and a journal ring 206, the elements being of 360° extent with one radial split 207 each. The journal rings are of a size to fit tightly within the half ring members 48,50 when assembled. The thrust flanges 205 are slightly dished as shown by their dimension 208 in their free state being slightly larger than the thrust gap between the stationary and rotatable cutting blade assemblies. Thus when the cutting device is assembled, any slop between the assemblies is taken up and the projection wedge 60 does not knock in the bifurcated end 62 of the striker block. The elements 204 are radially split to allow fitting of the line cutting device without pulling off the propeller.

Whilst one stationary blade is preferred, two or more may be used on the stationary cutting blade assembly. In the same way, one, two, four or more rotatable blades may be used on the rotatable cutting blade assembly. The cutting edges need be on one side only of the blades if there is no question of reverse rotation on the shaft.

I claim:

1. A line cutting device for mounting around a propeller shaft between a shaft bearing and a propeller comprising:

A. a rotatable cutting blade assembly mountable for rotation with the propeller shaft and including at least one rotatable cutting blade extending generally radially of the propeller shaft, each said rotatable cutting blade having an axially directed flat face and a circumferentially directed face, said faces of each cutting blade defining a cutting edge therebetween; and B. a stationary cutting blade assembly adapted to be restrained against rotation by co-operation with the shaft bearing and including a stationary cutting blade extending generally radially of the propeller shaft, said stationary cutting blade having an axially directed flat face and a circumferentially directed face, said faces defining a cutting edge therebetween, said stationary cutting blade assembly being arranged for cutting action of its cutting edge in conjunction with the cutting edge of each rotatable cutting blade on rotation of the propeller shaft with the axially directed faces passing opposite each other during such rotation, said circumferentially directed face of each rotatable cutting blade and said circumferentially directed face of said stationary cutting blade extend away from each other from their radially inner ends to the outer ends when in relative cutting position to each other; and C. serrations included on each cutting edge of each rotatable cutting blade and the cutting edge of the stationary cutting blade, each respective circumferentially directed face is provided with at least one tooth formation thereon, each tooth formation has a saw-tooth shape and each circumferentially directed face has its tooth formation raked back from its cutting edge, whereby each cutting edge is provided with points, the saw-tooth formations on each face being provided at equivalent radial spacing, whereby the points on the stationary cutting blade act at the same radius as the equivalent points on the rotatable cutting blade, the cutting edges being shaped for cutting action of radially inner ones of the serrations prior to such action of radially outer ones of said serrations on continued rotation of the propeller shaft.

2. A line cutting device as claimed in claim 1, wherein the circumferentially directed faces of each cutting plate curve towards each other from their radially inner end to their outer ends.

3. A line cutting device is claimed in claim 2, wherein the rotatable cutting blade assembly includes a split hub adapted for clamping to the propeller shaft, the hub having an annular groove at one end and a circular cylindrical seat at a mid portion for the stationary cutting blade assembly and having each rotatable cutting blade radiating from its other end with its axially directed face directed towards the circular cylindrical seat, and a split collar of greater radial dimension than the depth of the groove, clampable to the hub at the groove; whereby the stationary cutting blade assembly is axially limited in the seat.

4. A line cutting device as claimed in claim 3, wherein the stationary cutting blade assembly includes a split ring accommodatable at the circular cylindrical seat, and means for axially splitting the ring for mounting to the seat prior to fitting of the collar to the hub.

5. A line cutting device as claimed in claim 4, wherein the split ring comprises two half ring members, one half ring member having at its ends reduced radial dimension lugs connected to the member by neck portions defining inwardly facing notches, the other half ring member having at its ends reduced radial dimension lugs connected to the member by neck portions defining outwardly facing notches, the ring being assembled axially by fitting the lugs of one member into the notches of the other member.

6. A line cutting device as claimed in claim 5, wherein the split ring carries moulded, combined thrust and journal bearing elements.

7. A line cutting device as claimed in claim 6, wherein the bearing elements have thrust portions which are axially dished to take up axial slack between the stationary cutting assembly and the rotatable cutting assembly.

8. A line cutting device as claimed in claim 7, wherein the stationary cutting blade assembly is restrained by an integral projection engaging a striker block, the striker block being securable by central tension elements and spaced compression elements.

9. A line cutting device as claimed in claim 3, wherein the stationary cutting blade assembly is restrained by an integral projection engaging a striker block, the striker block being securable by central tension elements and spaced compression elements.

10. A line cutting device as claimed in claim 1, wherein the stationary cutting blade assembly is restrained by an integral projection engaging a striker block, the striker block being securable by central tension elements and spaced compression elements.

11. A line cutting device for mounting around a propeller shaft between a shaft bearing and a propeller comprising:

A. a rotatable cutting blade assembly mountable for rotation with the propeller shaft and including at least one rotatable cutting blade extending generally radially of the propeller shaft, each said rotatable cutting blade having an axially directed face and two circumferentially directed faces, said faces of each cutting blade defining cutting edges therebetween, the circumferentially directed faces of each rotatable cutting blade curve toward each other from their radially inner ends to their outer ends; and B. a stationary cutting blade assembly adapted to be restrained against rotation by co-operation with the shaft bearing and including a stationary cutting blade extending generally radially of the propeller shaft, said stationary cutting blade having an axially directed face and two circumferentially directed faces, said faces defining cutting edges therebetween, the circumferentially directed faces of said stationary cutting blade curve toward each other from their radially inner ends to their outer ends, said stationary cutting blade assembly being arranged for cutting action of its cutting edge in conjunction with the cutting edge of each rotatable cutting blade on rotation of the propeller shaft with the axially directed faces passing opposite each other during such rotation;

C. serrations included on at least one cutting edge of each rotatable cutting blade and the cutting edge of the stationary cutting blade, the cutting edges being shaped for cutting action of radially inner ones of the serrations prior to such action of radially outer ones of said serrations on continued rotation of the propeller shaft.

12. A line cutting device for mounting around a propeller shaft between a shaft bearing and a propeller comprising:

A. a rotatable cutting blade assembly mountable for rotation with the propeller shaft and including at least one rotatable cutting blade extending generally radially of the propeller shaft, each said rotatable cutting blade having an axially directed face and a circumferentially directed face, said faces of each cutting blade defining a cutting edge therebetween;

B. a stationary cutting blade assembly adapted to be restrained against rotation by co-operation with the shaft bearing and including a stationary cutting blade extending generally radially of the propeller shaft, said stationary cutting blade having an axially directed face and a circumferentially directed face, said faces defining a cutting edge therebetween, said stationary cutting blade assembly being arranged for cutting action of its cutting edge in conjunction with the cutting edge of each rotatable cutting blade on rotation of the propeller shaft with the axially directed faces passing opposite each other during such rotation;

C. the rotatable cutting blade assembly includes a split hub adapted for clamping to the propeller shaft, the hub having an annular groove at one end and a circular cylindrical seat at a mid portion for the stationary cutting blade assembly and having each rotatable cutting blade radiating from its other end with its axially directed face directed towards the circular cylindrical seat, and a split collar of greater radial dimension than the depth of the groove, clampable to the hub at the grove; whereby the stationary cutting blade assembly is axially limited in the seat; and D. serrations included on at least one cutting edge of each rotatable cutting blade and the cutting edge of the stationary cutting blade, the cutting edges being shaped for cutting action of radially inner ones of the serrations prior to such action of radially outer ones of said serrations on continued rotation of the propeller shaft.

13. A line cutting device for mounting around a propeller shaft between a shaft bearing and a propeller comprising:

A. a rotatable cutting blade assembly mountable for rotation with the propeller shaft and including at least one rotatable cutting blade extending generally radially of the propeller shaft, each said rotatable cutting blade having an axially directed face and a circumferentially directed face, said faces of each cutting blade defining a cutting edge therebetween;

B. a stationary cutting blade assembly adapted to be restrained against rotation by co-operation with the shaft bearing and including a stationary cutting blade extending generally radially of the propeller shaft, said stationary cutting blade having an axially directed face and a circumferentially directed face, said faces defining a cutting edge therebetween, said stationary cutting blade assembly being arranged for cutting action of its cutting edge in conjunction with the cutting edge of each rotatable cutting blade on rotation of the propeller shaft with the axially directed faces passing opposite each other during such rotation;

C. thrust bearing means between said rotatable cutting blade assembly and said stationary cutting blade assembly for limiting axial approach of said rotatable cutting blade and said stationary cutting blade, whereby said axially directed face of said rotatable cutting blade remains spaced from said axially directed face of said stationary cutting blade;

D. serrations included on at least one cutting edge of each rotatable cutting blade and the cutting edge of the stationary cutting blade, the cutting edges being shaped for cutting action of radially inner ones of the serrations prior to such action of radially outer ones of said serrations on continued rotation of the propeller shaft.

14. A line cutting device for mounting around a propeller shaft between a shaft bearing and a propeller comprising:

A. a rotatable cutting blade assembly mountable for rotation with the propeller shaft and including at least one rotatable cutting blade extending generally radially of the propeller shaft, each said rotatable cutting blade having an axially directed face and a circumferentially directed face, said faces of each cutting blade defining a cutting edge therebetween;

B. a stationary cutting blade assembly adapted to be restrained against rotation by co-operation with the shaft bearing and including a stationary cutting blade extending generally radially of the propeller shaft, said stationary cutting blade having an axially directed face and a circumferentially directed face, said faces defining a cutting edge therebetween, said stationary cutting blade assembly being arranged for cutting action of its cutting edge in conjunction with the cutting edge of each rotatable cutting blade on rotation of the propeller shaft with the axially directed faces passing opposite each other during such rotation, said circumferentially directed face of each rotatable cutting blade and said circumferentially directed face of said stationary cutting blade curve away from each other from their radially inner ends to the outer ends when in relative cutting position to each other; and C. serrations included on at least one cutting edge of each rotatable cutting blade and the cutting edge of the stationary cutting blade, the cutting edges being shaped for cutting action of radially inner ones of the serrations prior to such action of radially outer ones of said serrations on continued rotation of the propeller shaft.

15. A line cutting device for mounting around a propeller shaft between a shaft bearing and a propeller comprising:

A. a rotatable cutting blade assembly mountable for rotation with the propeller shaft and including at least one rotatable cutting blade extending generally radially of the propeller shaft, each said rotatable cutting blade having an axially directed face and a circumferentially directed face, said faces of each cutting blade defining a cutting edge therebetween;

B. a stationary cutting blade assembly adapted to be restrained against rotation by co-operation with the shaft bearing and including a stationary cutting blade extending generally radially of the propeller shaft, said stationary cutting blade having an axially directed face and a circumferentially directed face, said faces defining a cutting edge therebetween, said stationary cutting blade assembly being arranged for cutting action of its cutting edge in conjunction with the cutting edge of each rotatable cutting blade on rotation of the propeller shaft with the axially directed faces passing opposite each other during such rotation, said circumferentially directed face of each rotatable cutting blade and said circumferentially directed face of said stationary cutting blade extend away from each other from their radially inner ends to the outer ends when in relative cutting position to each other; and C. serrations included on at least one cutting edge of each rotatable cutting blade and the cutting edge of the stationary cutting blade, the cutting edges being shaped for cutting action of radially inner ones of the serrations prior to such action of radially outer ones of said serrations on continued rotation of the propeller shaft.

* * * * *